US007424789B2

(12) United States Patent
Zhou

(10) Patent No.: US 7,424,789 B2
(45) Date of Patent: Sep. 16, 2008

(54) BRACKET SYSTEM FOR MODULAR FIREPLACE MANTEL

(75) Inventor: David Zhou, 745 E. Valley Blvd., #829, San Gabriel, CA (US) 91776

(73) Assignee: David Zhou

( * ) Notice: Subject to any disclaimer, the term of this patent is extended or adjusted under 35 U.S.C. 154(b) by 366 days.

(21) Appl. No.: 11/218,890

(22) Filed: Sep. 2, 2005

(65) Prior Publication Data

US 2006/0101725 A1 May 18, 2006

Related U.S. Application Data

(60) Provisional application No. 60/627,260, filed on Nov. 12, 2004.

(51) Int. Cl.
*F24B 3/00* (2006.01)
*F24B 13/00* (2006.01)

(52) U.S. Cl. ..... 52/36.3; 52/27; 126/500

(58) Field of Classification Search ..... 52/36.3, 52/315, 385, 389, 704, 506.01, 27, 36.1; 248/300; D23/405, 403, 404; 126/500, 83, 126/544, 8
See application file for complete search history.

(56) References Cited

U.S. PATENT DOCUMENTS 269,551 A * 12/1882 Thweattt ..... 126/500
400,689 A * 4/1889 Keyser ..... 126/500
868,411 A * 10/1907 Oilek ..... 52/584.1
1,171,717 A * 2/1916 Haddox ..... 52/36.3
3,245,185 A * 4/1966 Rowe ..... 52/315
3,397,498 A * 8/1968 Murphy ..... 52/385
3,621,635 A * 11/1971 Lange ..... 52/235
3,724,152 A * 4/1973 Castellarin ..... 52/378
3,736,715 A * 6/1973 Krumwiede ..... 52/309.11
3,817,012 A * 6/1974 Wack et al. ..... 52/315
3,925,944 A * 12/1975 Pickel ..... 52/134
4,013,059 A * 3/1977 Andrews ..... 126/500
4,029,076 A * 6/1977 Simington ..... 126/539
4,045,933 A * 9/1977 Grillo ..... 52/475.1
4,108,144 A * 8/1978 Wilhoite ..... 126/518
4,219,005 A * 8/1980 Boahn ..... 126/517
4,362,147 A * 12/1982 Taglavore ..... 126/547
4,453,359 A * 6/1984 Robinson ..... 52/389
4,531,338 A * 7/1985 Donatt ..... 52/235
4,542,736 A * 9/1985 Scheler ..... 126/539
4,551,958 A * 11/1985 Reneault et al. ..... 52/309.4
4,642,960 A * 2/1987 Wallover, III ..... 52/390
4,686,807 A * 8/1987 Newsome ..... 52/314
4,691,490 A * 9/1987 Leaver ..... 52/293.3

(Continued)

*Primary Examiner*—Phi Dieu Tran A
(74) *Attorney, Agent, or Firm*—Clement Cheng

(57) ABSTRACT

A master bracket system is provided to install a modular fireplace mantel at a fireplace opening. The bracket is generally C-shaped having a base plain and a number of planar extensions with predetermined angles to one another. Each of the plain surfaces of the bracket has an eyelet at the mounting point to receive a bolt that secures the corresponding marble member to the bracket. The base plain provides a retaining base for a main bolt to hold the entire mantel assembly to the wall. A number of brackets are used for each of the opposite sides of the mantel structure against the structure wall. The bracket has bolts each threaded through the eyelets into connection with a machined metal insert, which is embedded within the mantel members and held in place by adhesive.

7 Claims, 4 Drawing Sheets

U.S. PATENT DOCUMENTS 4,878,481 A * 11/1989 Schoeff et al. ..... 126/307 R
4,930,278 A * 6/1990 Staresina et al. ..... 52/315
4,947,600 A * 8/1990 Porter ..... 52/235
5,493,834 A * 2/1996 Nelson ..... 52/349
5,501,049 A * 3/1996 Francis et al. ..... 52/387
5,715,637 A * 2/1998 Hesterman et al. ..... 52/315
5,787,666 A * 8/1998 Sherry ..... 52/315
5,976,670 A * 11/1999 Fugazzi ..... 428/161
6,006,944 A * 12/1999 Machledt ..... 220/567.1
6,240,691 B1 * 6/2001 Holzkaemper et al. ..... 52/315
6,718,714 B1 * 4/2004 Montgomery, Sr. ..... 52/392
6,811,357 B1 * 11/2004 Haug ..... 405/285
6,857,241 B1 * 2/2005 Pellicer ..... 52/583.1

* cited by examiner

BRACKET SYSTEM FOR MODULAR FIREPLACE MANTEL

RELATED APPLICATION DATA

This application claims priority to Provisional U.S. patent application Ser. No. 60/627,260, filed Nov. 12, 2004, entitled, "MODULAR FIREPLACE MANTEL BRACKET SYSTEM", by David Zhou, which is hereby incorporated by reference.

BACKGROUND OF THE INVENTION

A. Field of the Invention

The present invention relates to fireplace mantels, and more particularly to an improved bracket system for installing modular mantels surrounding fireplaces.

B. Description of the Prior Art

The decorative fireplace mantels are for installation on the wall area in front of in-wall fireplaces to become a focal point of the room. Mantels are custom made or mass produced in kit forms. A mantel kit usually comes in component pieces that require more than one person to properly assemble and install on site. Mantels are made of heavy stones, woods or their simulated materials and generally take the shape of artistic architectural design of ancient building or pillar parts.

Among installation tools and materials it is known to use brackets or adhesive glue to assemble and install components of a mantel on the structure wall. Typically, to install a mantel in the kit form involves cutting to suit the dimensions of individual fireplace, assembling a couple of multi-faceted legs with glue, a top cross member, face member and top shelf. Entire hands of family and more are recommended to hold each leg assembly, each of the opposite sides of the top shelf and the face member at least.

In particular, most man-hours are consumed to erect the mantel legs each made up of three or more planar members and glue them to each other one by one with all of their set angles maintained manually until glue is dry and same process is repeated for the second set of leg members. Because of the heavy weight of the mantel members and the dry time of glue, mantel installation has been a demanding job with an unpredictable degree of success for the most layman consumers lacking a simpler means for fixture.

In an ideal situation, the consumer unmistakably follows the manufacturer's instructions from unpacking the mantel components to a successful installation of the mantel completing the transaction in a pleasant mood. However, even with adequate caution misunderstandings or unskilled actions arise and irrevocable damages happen to the stone or other materials during installation, when both parties suffer from extra cost and time for replacement parts.

It is, therefore, necessary to improve the fixture system to ensure a consistent installation success of modular mantel be it a custom-made or mass-produced product.

The conventional bracket method of installation is shown in U.S. Pat. No. 6,796,088 at its FIGS. 9-10a suggesting flat brackets with either round or elongated openings through which screws and bolts are driven directly into two adjacent mantel members of legs and breast to couple the same together.

The above and other prior arts have yet to provide a simple means for fixture in the form of a master bracket, which threads through multiple mantel components for fastening to the structure wall in a single step requiring minimum supporting hands and waiting time associated with using conventional glue method.

Accordingly, the general object of the present invention is to provide a positive and simple means to simultaneously assemble and fasten multiple mantel components in unity to the structure wall.

SUMMARY OF THE INVENTION

A variety of marble elements, or sections can be created independently and secured together with the master brackets of the present invention. The brackets allow the entire mantel legs and other components to be attached to a wall and to other elements without using glue.

The bracket is preferably made of steel into a general C-shape having a base plain and a number of planar extensions with predetermined angles to one another. The base plain and distal extension lie in parallel to the structure wall. And each of the angles corresponds to that of the mantel members standing against the wall. Each of the plain surfaces of the bracket has an eyelet at the mounting point to receive a bolt that secures the corresponding marble member to the bracket. The base plain provides a retaining base for a main bolt to hold the entire mantel assembly to the wall. A number of brackets are used for each of the opposite sides of the mantel structure against the structure wall.

The bracket has bolts each threaded through the eyelets into connection with a fastener insert, which may be a machined metal embedded within the mantel members and held in place by adhesive. The metal inserts have a fastening means such as screw thread receiving the screw thread of the bolts. Once bolted together with the bolts tightened, the gaps between the separate mantel members will come in close proximity so that the mantel exterior in general appears continuous for a streamlined look. The main bolt that secures the master bracket to the structure wall pass through the preferably unthreaded aperture formed in the bracket.

Normally, four to six master brackets can be used to bind the modular sections into a cohesive mantel unit as well as attach the unit to the wall.

The bracket of the present invention allows the stone legs to stand immediately during installation without needing manual supports and ready for further installation of the top cross member and the front stone member. The front stone member is also fastened at its opposite sides by a couple of the master brackets so that it rests on the top surfaces of the front leg members defining a top inside edge of the fireplace mantel. A top shelf laid on top of the leg members finishes mantel installation.

DETAILED DESCRIPTION OF THE PREFERRED EMBODIMENT

Figure 1:
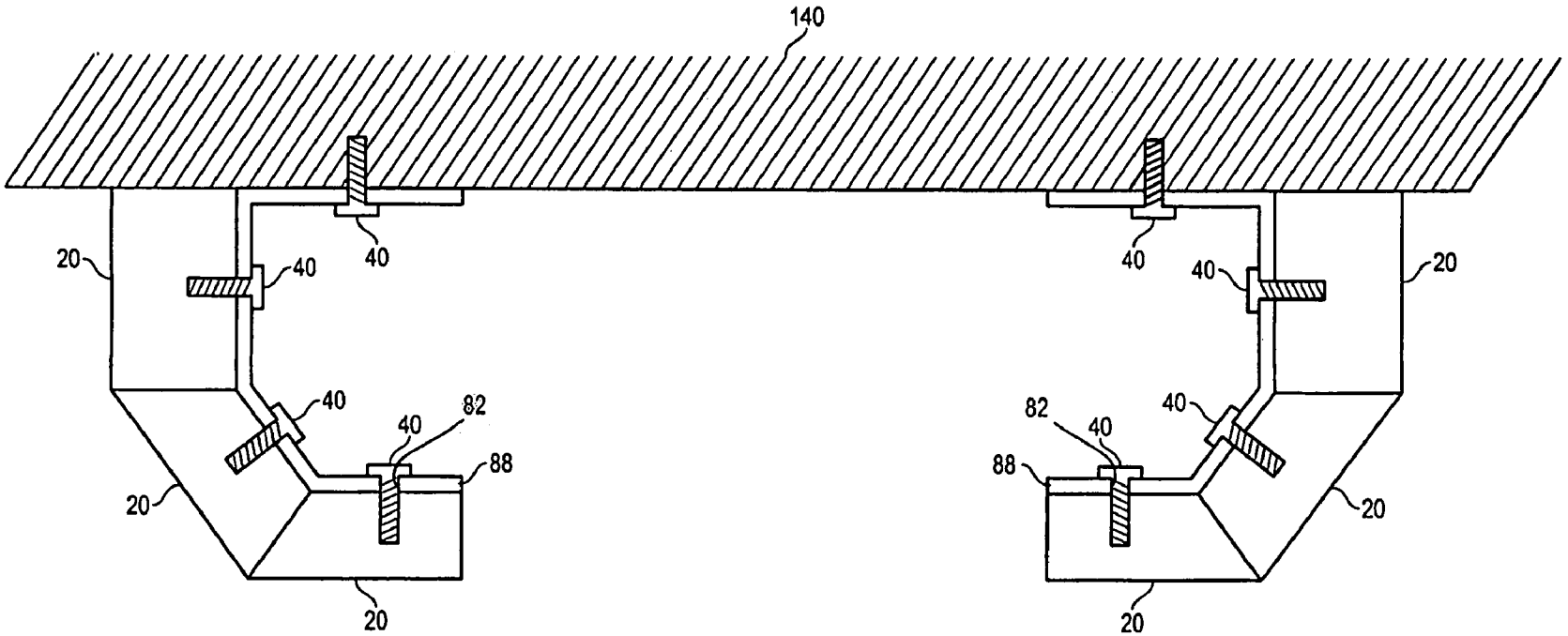
FIG. 1 is a top schematic view of a modular mantel installed utilizing a bracket mounting according to the present invention.

Referring to FIG. 1, mantel members 20 are shown in top view as fastened by a couple of left and right master brackets 88 each formed as a single piece fastener with a built-in angle setting, to a structure wall 140 surrounding an in-wall fireplace not shown.

The bracket 88 is preferably made of steel into a general C-shape having a base plain and a number of planar extensions with predetermined angles to one another. The base plain and distal extension lie in parallel to the wall 140. And each of the angles corresponds to that of the mantel members 20 standing against the wall. The plain surfaces of the bracket 88 each have an eyelet 82 at the mounting point to receive a bolt 40 that secures the corresponding marble member 20 to the bracket 88. The base plain of the bracket 88 provides a retaining base for a main bolt 40 to hold the entire mantel assembly to the wall 140. A number of brackets 88 are used for each of the opposite sides of the mantel structure against the structure wall 140.

The mantel members 20 are typically comprised at its either side of a front leg, an angled leg member and an outside leg member, which are made of a solid marble material in this embodiment.

The bracket 88 is preferably made of steel.

Figure 2:
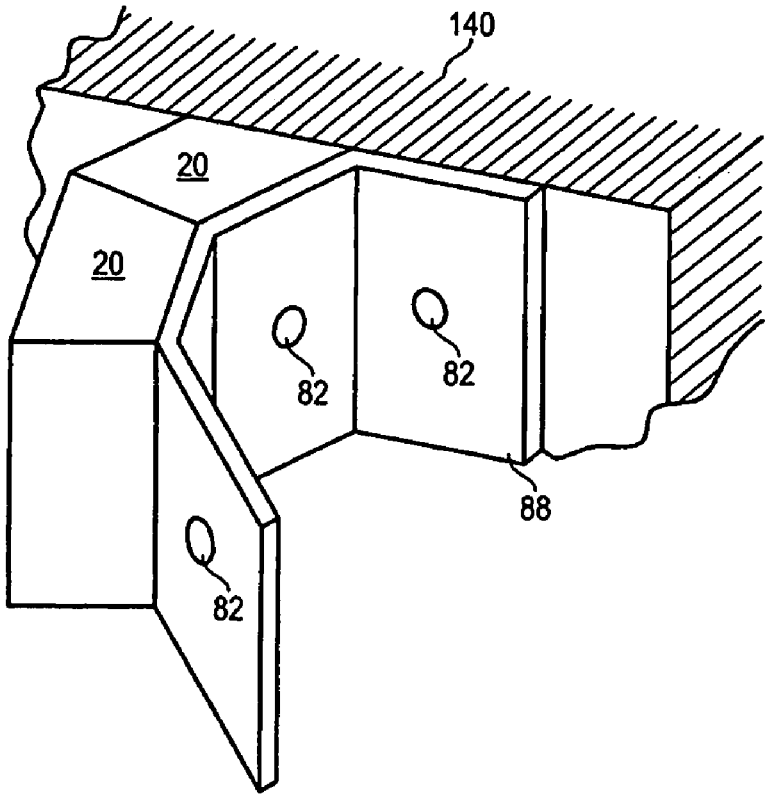
FIG. 2 is a perspective view of the bracket mounting of FIG. 1 in the process of mantel assembly.

FIG. 2 shows a perspective view of a left master bracket 88 partially attached with marble sections 20. The marble, or stone sections 20 preferably have a decorated face or exterior design, which is not shown in FIG. 2 for the sake of clarity in the front stone section.

Figure 3:
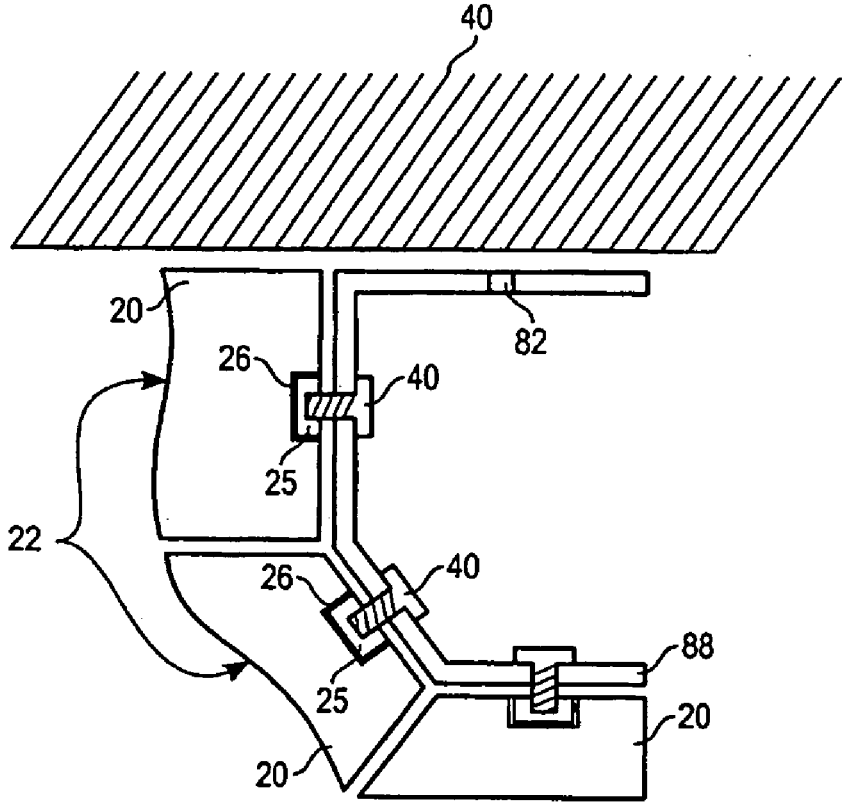
FIG. 3 is a perspective view of the bracket mounting illustrating the fastening system in more detail.

FIG. 3 is a close up top cross-section of the left master bracket 88. The bracket 88 has bolts 40 each threaded through the eyelets 82 of the bracket 88 into a connection with a fastener insert 25, which may be a machined metal embedded within the stone section 20 and held in place by adhesive 26. The metal inserts 25 have a fastening means such as screw thread receiving the screw thread of the bolts 40.

Once bolted together with the bolts 40 tightened, the gaps between the stones sections 20 will come in close proximity so that the exterior design 22 appears continuous for a streamlined look of mantel leg. Not shown in FIG. 3 is the wall bolt that secures the master bracket 88 to the structure wall by means of the preferably unthreaded aperture 82.

Figure 4:
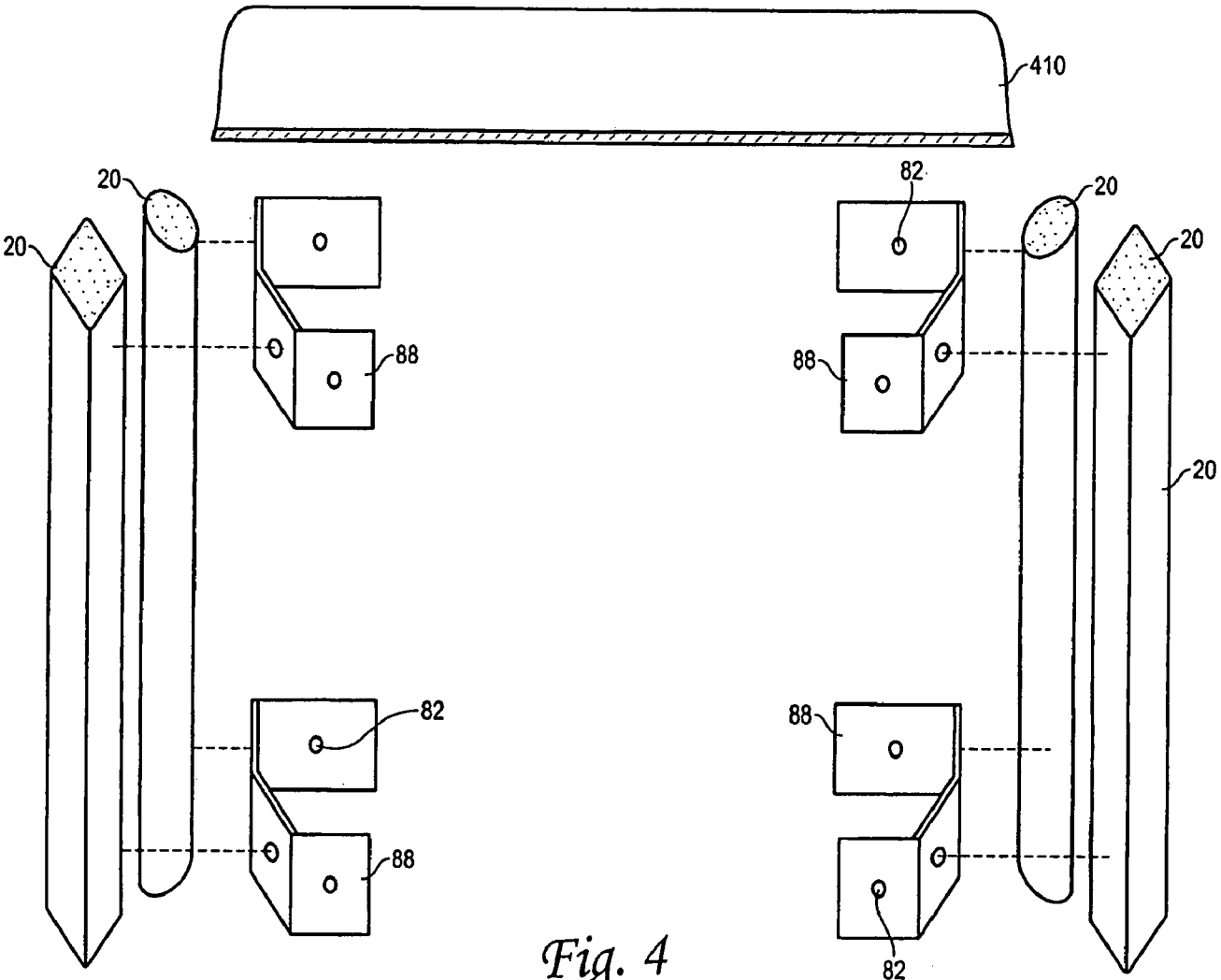
FIG. 4 is an exploded perspective view of the mantel and the bracket with the front leg members omitted for clarity.

FIG. 4 shows an exploded view of the entire mantel fixture utilizing the master bracket system according to the invention. A plurality of brackets 88 is used to fasten the leg members together at their top and bottom portions. Normally, four to six master brackets 88 can be used to bind the modular sections into a cohesive mantel unit as well as attach the unit to the wall.

Now the stone legs 20 are free-standing without needing manual supports and ready for further installation of the top cross member, which is omitted in FIG. 4 for the sake of clarity as is the front stone member. The front stone member is also fastened at its opposite sides by a couple of the master brackets 88 so that it rests on the top surfaces of the front leg members 20 defining a top inside edge of the fireplace mantel. Eventually, a top shelf 410 may rest on top of the stone legs 20.

While the presently preferred form of the master bracket system for modular fireplace mantel has been shown and described, persons skilled in this art will readily appreciate that various additional changes and modifications may be made without departing from the spirit of the invention, as defined and differentiated by the following claims.

The invention claimed is:

1. A bracket system for a modular fireplace mantel comprising:

a. a plurality of brackets, wherein each bracket has a wall mounting side for facing a wall, and a plurality of flat stone mounting sides; each of the sides being at angle to its adjacent side and angle being non-zero degree;

b. at least one eyelet formed in each stone mounting side of each bracket, wherein there are a number of eyelets;

c. stone sections mounted on the brackets, wherein the stone sections are mounted on a plurality of the stone mounting sides, the stone sections comprising leg members formed as stone columns collectively establishing a flat top surface;

d. a top shelf mounted over the flat top surface;

e. bolts mounting the stone sections to the brackets; wherein the brackets have a number of mounting points formed as the eyelets that align to the mounting points on the stone sections, and f. metal inserts having a thread complementary to the bolts, wherein the metal inserts are mounted on the stone sections receiving the bolts whereby mounting the stone sections on the brackets.

2. The bracket system for modular fireplace mantel set forth in claim 1, wherein the metal inserts are nuts glued into grooves formed on a vertical surface of the stone sections, wherein the metal inserts have a fastening means.

3. The bracket system for modular fireplace mantel set forth in claim 1, wherein the stone is a natural marble material.

4. The bracket system for modular fireplace mantel set forth in claim 1, wherein there are at least three flat stone mounting sides, and one wall mount side.

5. A bracket system for a modular fireplace mantel comprising:

a. a plurality of brackets, wherein each bracket has a wall mounting side for facing a wall, and a plurality of flat stone mounting sides; wherein there are at least three flat stone mounting sides, and one wall mounting sides; wherein each of the sides being at an angle to its adjacent side and the angle being non-zero degree;

b. at least one eyelet formed in each stone mounting side of each bracket, wherein there are a number of eyelets;

c. stone sections mounted on the brackets, wherein the stone sections are mounted on a plurality of the stone mounting sides, the stone sections comprising leg members formed as stone columns collectively establishing a flat top surface;

d. a top shelf mounted over the flat top surface;

e. bolts mounting the stone sections to the brackets; wherein the eyelets align the stone sections, and f. metal inserts having a thread complementary to the bolts, wherein the metal inserts are mounted on the stone sections receiving the bolts whereby mounting the stone sections on the brackets.

6. The bracket system for modular fireplace mantel set forth in claim 5, wherein the metal inserts are nuts glued into grooves formed on a vertical surface of the stone sections, wherein the metal inserts have a fastening means.

7. The bracket system for modular fireplace mantel set forth in claim 5, wherein the stone is a natural marble material.

* * * * *